US008431317B2

(12) United States Patent
Tsubaki et al.

(10) Patent No.: US 8,431,317 B2
(45) Date of Patent: Apr. 30, 2013

(54) METHOD FOR MANUFACTURING CAPSULE TONER

(75) Inventors: Yoritaka Tsubaki, Osaka (JP); Yoshitaka Kawase, Osaka (JP); Keiichi Kikawa, Osaka (JP); Yoshinori Mutoh, Osaka (JP); Takashi Hara, Osaka (JP); Yoshiaki Akazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 208 days.

(21) Appl. No.: 13/009,297

(22) Filed: Jan. 19, 2011

(65) Prior Publication Data

US 2011/0177451 A1 Jul. 21, 2011

(30) Foreign Application Priority Data

Jan. 20, 2010 (JP) ..... P2010-010515

(51) Int. Cl.
*G03G 5/00* (2006.01)

(52) U.S. Cl.
USPC ..... 430/137.11; 430/110.2; 430/137.1

(58) Field of Classification Search ..... 430/110.2, 430/137.1, 137.11
See application file for complete search history.

(56) References Cited

U.S. PATENT DOCUMENTS

| | | | | |
|---|---|---|---|---|
| 5,708,941 | A | 1/1998 | Koga et al. | |
| 6,686,112 | B2 | 2/2004 | Teshima et al. | |
| 8,197,999 | B2 * | 6/2012 | Kawase et al. | 430/137.1 |
| 2009/0011357 | A1 * | 1/2009 | Kawase et al. | 430/110.1 |
| 2009/0297224 | A1 * | 12/2009 | Kawase et al. | 399/252 |
| 2010/0061767 | A1 * | 3/2010 | Kawase et al. | 399/252 |
| 2010/0080629 | A1 * | 4/2010 | Hara et al. | 399/252 |
| 2010/0159374 | A1 * | 6/2010 | Mutoh et al. | 430/105 |
| 2010/0248114 | A1 * | 9/2010 | Hara et al. | 430/105 |
| 2011/0053074 | A1 * | 3/2011 | Hara et al. | 430/108.4 |
| 2011/0059394 | A1 * | 3/2011 | Mutoh et al. | 430/110.2 |
| 2011/0070541 | A1 * | 3/2011 | Tsubaki et al. | 430/110.2 |
| 2011/0111338 | A1 * | 5/2011 | Akazawa et al. | 430/137.13 |
| 2011/0171574 | A1 * | 7/2011 | Hara et al. | 430/137.11 |

FOREIGN PATENT DOCUMENTS

| | | |
|---|---|---|
| JP | 63-198070 | 8/1988 |
| JP | 04-118664 | 4/1992 |
| JP | 04-182660 | 6/1992 |
| JP | 2001-324831 | 11/2001 |
| JP | 2009-025669 | 2/2009 |
| JP | 2009-131849 | 6/2009 |
| JP | 2010-9003 | 1/2010 |

* cited by examiner

*Primary Examiner* — Stewart Fraser
(74) *Attorney, Agent, or Firm* — Nixon & Vanderhye, P.C.

(57) ABSTRACT

A method for manufacturing a capsule toner, capable of obtaining a capsule toner including a coating layer having uniform thickness at high yield is provided. The method for manufacturing a capsule toner includes a fine resin particle adhering step of adhering fine resin particles to surfaces of toner base particles, a spraying step of spraying a spray liquid for plasticizing the toner base particles and the fine resin particles, while fluidizing the toner base particles and the fine resin particles, and a film-forming step of fluidizing the toner base particles and the fine resin particles until the fine resin particles adhered to the surfaces of the toner base particles are softened to form a film. In the spraying step, ultrasonic vibration is applied to set a number average liquid-droplet diameter of the spray liquid to less than 10 μm.

2 Claims, 5 Drawing Sheets

METHOD FOR MANUFACTURING CAPSULE TONER

CROSS-REFERENCE TO RELATED APPLICATION

This application claims priority to Japanese Patent Application No. 2010-010515, which was filed on Jan. 20, 2010, the contents of which are incorporated herein by reference in its entirety.

BACKGROUND OF THE INVENTION

1. Field of the Invention

The present invention relates to a method for manufacturing a capsule toner.

2. Description of the Related Art

As a method for manufacturing a toner, a wide variety of kneading pulverization methods have been conventionally used, but since the pulverized toner usually has an irregular shape with a lot of unevenness on the surface thereof and the broken surface after pulverization becomes the surface of the toner particle as it is, the surface composition thereof easily becomes non-uniform and it is hard to uniformly regulate the surface state of the toner particle. If the shape of the toner particle surface has an irregular shape with a lot of unevenness, there are problems, for example, in that flowability of the toner is reduced or non-uniformity of the toner composition is caused, and further, fogging or toner spatter, and the like occur.

In consideration of such problems of the irregular shape of the toner particle surface, various wet methods in which a dispersion liquid of toner raw materials is mixed and aggregated to manufacture a toner have been suggested, which may replace the kneading pulverization method. However, in the case of the wet methods, there are drawbacks that since dispersion stabilizing agents or aggregating agents are widely used, a part of the components remain on the toner particle surface or the inside thereof, thereby causing reduction in moisture resistance or deterioration of charge characteristics, and in particular, creation of instability of charge characteristics.

Meanwhile, as there has been a recent demand for high-quality images, there has been a tendency that the particle size of toners has progressively become smaller and the content of a toner having a small particle size as fine powders in the two-component developer has increased. In a two-component developer including a toner having a small particle size, there occurs toner spent into a carrier owing to cracks of a toner having a small particle size due to the stress inside a developing device or change in the shape, and correspondingly, deterioration of the charge of the developer, and further, a development or transfer process is caused to be affected, thereby leading to deterioration of image quality.

Furthermore, as images have recently become colored, there is a tendency that the color toner is progressively subjected to low-temperature fixing and low-temperature softening materials are used as toner components.

Accordingly, as a toner having good flowability, transfer property, or the like, uniform charge performance, an excellent anti-offset property, and other various functions, a capsule toner in which the surface of a toner base particle is coated with a resin layer is proposed.

Japanese Unexamined Patent Publication JP-A 63-198070 (1988) discloses an electrostatic toner in which toner particles, hydrophobic fine resin particles, and other required fine particles are mixed by means of mechanical strain, and the surfaces of the toner particles are coated.

As a method for preparing a capsule toner, a method of spraying a liquid for plasticizing toner base particles and fine resin particles to form a coating layer is known, and this method is advantageous in that the resin coating layer is uniformly formed.

However, according to the conditions for spraying the liquid, the spray liquid cannot be uniformly sprayed on a mixture of the toner base particles and the fine resin particles, and as a result, there occur aggregation of the mixture occurs or adherence thereof to the inner wall of the apparatus, and reduction in a yield as well as non-uniformity in thickness of the coating layer.

Furthermore, a toner having non-uniform thickness of the coating layer easily varies in the image densities and has poor fixability, and also, a developer including the toner causes a problem in terms of high-temperature stability.

SUMMARY OF THE INVENTION

An object of the invention is to provide a method for manufacturing a capsule toner, capable of obtaining a capsule toner comprising a coating layer having uniform thickness at high yield.

The invention provides a method for manufacturing a capsule toner, comprising:

a fine resin particle adhering step of adhering fine resin particles to surfaces of toner base particles;

a spraying step of spraying a spray liquid for plasticizing the toner base particles and the fine resin particles, while fluidizing the toner base particles and the fine resin particles; and a film-forming step of fluidizing the toner base particles and the fine resin particles until the fine resin particles adhered to the surfaces of the toner base particles are softened and form a film, in the spraying step, ultrasonic vibration being applied to set a number average liquid-droplet diameter of the spray liquid to less than 10 μm.

According to the invention, a capsule toner manufacturing method comprises a fine resin particle adhering step of adhering the fine resin particles to surfaces of toner base particles; a spraying step of spraying a spray liquid for plasticizing the toner base particles and the fine resin particles, while fluidizing the toner base particles and the fine resin particles; and a film-forming step of fluidizing the toner base particles and the fine resin particles until the fine resin particles adhered to the surfaces of the toner base particles are softened and form a film, and in the spraying step, ultrasonic vibration is applied to set a number average liquid-droplet diameter of the spray liquid to less than 10 μm. Therefore, the toner base particles and the fine resin particles in a fluidized state can be sprayed with a spray liquid having a number average liquid-droplet diameter of less than 10 μm. By setting the number average liquid-droplet diameter of the spray liquid to less than 10 μm, aggregation of the toner base particles and the fine resin particles can be suppressed and adherence of the particles to the inside of the apparatus can also be prevented. Further, since the spray liquid can be uniformly spread on the toner base particles and the fine resin particles in a fluidized state, uniform impact force is applied to the toner base particles adhered with the fine resin particles, and uniform film formation among the fine resin particles can be promoted. As a result, aggregation between the toner particles and variability in the coating states among the toner particles can be suppressed, and a capsule toner having a resin coating layer with uniform film thickness can be obtained at high yield. Further, by making the film thickness of the resin coating layer uniform, a capsule toner having good image stability or good fixability of the toner can be obtained.

Moreover, in the invention, it is preferable that a number average liquid-droplet diameter of the spray liquid in the spraying step is less than 5 μm.

According to the invention, in the spraying step, since the number average liquid-droplet diameter of the spray liquid is less than 5 μm, the spray liquid can be uniformly spread on the toner base particles and the fine resin particles. As a result, a capsule toner comprising a resin coating layer having more uniform film thickness can be obtained at higher yield.

Further, the invention provides a capsule toner manufactured by the method as described above.

According to the invention, since the capsule toner is manufactured by the above-described method, a capsule toner having good image stability or good fixability of the toner can be obtained, and further, by incorporating the capsule toner, a developer having good high-temperature stability can be obtained.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
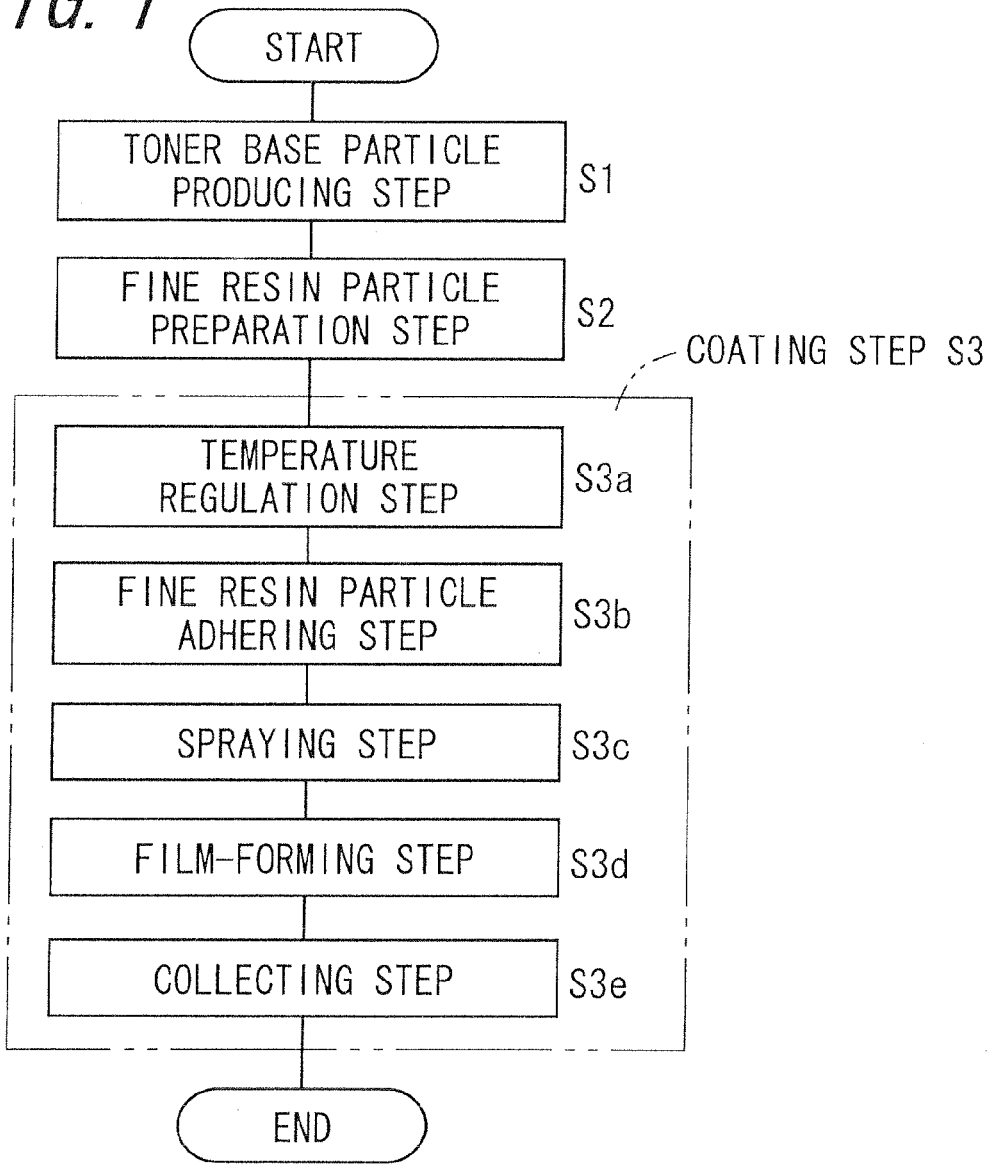
FIG. 1 is a flowchart of an example of a procedure for a method for manufacturing a capsule toner of the invention.

Now referring to the drawings, preferred embodiments of the invention are described below.

1. Method for Manufacturing Capsule Toner

FIG. 1 is a flowchart of an example of a procedure for a method for manufacturing a capsule toner of the invention. The method for manufacturing a capsule toner of the invention includes a toner base particle producing step S1 for producing toner base particles, a fine resin particle preparation step S2 for preparing fine resin particles, and a coating step S3 for coating the toner base particles with fine resin particles.

(1) Toner Base Particle Producing Step S1

In the toner base particle producing step S1, toner base particles to be coated with fine resin particles are produced. The toner base particles are particles each containing a binder resin and a colorant, and a method for producing the toner base particles is not particularly limited, but it can be carried out according to a known method. Examples of the method for producing the toner base particles include dry methods such as a pulverization method, and wet methods such as a suspension polymerization method, an emulsion aggregation method, a dispersion polymerization method, a dissolution suspension method, or a melting emulsion method. The method for producing the toner base particles according to the pulverization method will be described below.

(Method for Producing Toner Base Particles by Pulverization Method)

In a method for producing toner base particles by a pulverization method, a toner composition containing a binder resin, a colorant, and other additives is dry-mixed by a mixer, and then melt-kneaded by a kneader. The kneaded material obtained by melt-kneading is cooled and solidified, and then the solidified material is pulverized by a pulverizer. Subsequently, adjustment of a particle size such as classification is, if needed, carried out to obtain the toner base particles.

As the mixer, a known one can be used, and examples thereof include Henschel-type mixers such as HENSCHEL MIXER (trade name, manufactured by Mitsui Mining Co., Ltd.), SUPERMIXER (trade name, manufactured by Kawata MEG Co., Ltd.), MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.)

As the kneader, a known one can be used, and for example, commonly-used kneaders such as a twin-screw extruder, three rolls, a laboplast mill, and the like can be used. Specific examples of such a kneader include single or twin screw extruders such as TEM-100B (trade name, manufactured by Toshiba Machine Co., Ltd.), PCM-65/87 and PCM-30 (both trade names, manufactured by Ikegai, Co., Ltd.), and open roll-type kneaders such as KNEADEX (trade name, manufactured by Mitsui Mining Co., Ltd.) Among them, the open roll-type kneaders are preferable.

Examples of the pulverizer include a jet pulverizer which performs pulverization using an ultrasonic jet air stream, and an impact pulverizer which performs pulverization by guiding a solidified material to a space formed between a rotator that is rotated at high speed (rotor) and a stator (liner).

For the classification, a known classifier that is capable of removing excessively pulverized toner base particles by classification with a centrifugal force or classification with a wind force can be used, and examples thereof include a revolving type wind-force classifier (rotary type wind-force classifier).

(Toner Base Particle Raw Material)

As described above, the toner base particles contain the binder resin and the colorant. The binder resin is not particularly limited and any known binder resin used for a black toner or a color toner can be used, and examples thereof include styrene-based resins such as polystyrene or styrene-acrylate copolymer resin, acrylic resins such as polymethyl methacrylate, polyolefin resins such as polyethylene, polyester, polyurethane, and an epoxy resin. Further, a resin obtained by mixing a raw material monomer mixture with a release agent, and performing a polymerization reaction may be used. The binder resins may be used each alone, or two or more of them may be used in combination.

Among the binder resins as described above, polyester is preferable as a binder resin for a color toner due to its excellent transparency as well as good powder flowability, low-temperature fixability, secondary color reproducibility, and the like to be provided for the toner particles. For polyester, known substances may be used and examples thereof include a polycondensate of a polybasic acid and a polyvalent alcohol.

For the polybasic acid, substances known as monomers for polyester can be used including, for example: aromatic carboxylic acids such as terephthalic acid, isophthalic acid, phthalic anhydride, trimellitic anhydride, pyromellitic acid, or naphthalene dicarboxylic acid; aliphatic carboxylic acids such as maleic anhydride, fumaric acid, succinic acid, alkenyl succinic anhydride, or adipic acid; and methyl-esterified compounds of these polybasic acids. The polybasic acids may be used each alone, or two or more of them may be used in combination.

For the polyvalent alcohol, substances known as monomers for polyester can also be used including, for example: aliphatic polyvalent alcohols such as ethylene glycol, propylene glycol, butenediol, hexanediol, neopentyl glycol, or glycerin; alicyclic polyvalent alcohols such as cyclohexanediol, cyclohexanedimethanol, or hydrogenated bisphenol A; and aromatic diols such as ethylene oxide adduct of bisphenol A, or propylene oxide adduct of bisphenol A. The polyvalent alcohols may be used each alone, or two or more of them may be used in combination.

The polybasic acid and the polyvalent alcohol can undergo a polycondensation reaction in an ordinary manner, that is, for example, the polybasic acid and the polyvalent alcohol are brought into contact with each other in the presence of the organic solvent and the polycondensation catalyst. The polycondensation reaction ends when an acid number, a softening temperature, or the like of polyester to be prepared reaches predetermined values. Polyester can be thus obtained.

When the methyl-esterified compound of the polybasic acid is used as part of the polybasic acid, a dimethanol polycondensation reaction is caused. In this polycondensation reaction, a compounding ratio, a reaction rate, and the like of the polybasic acid and the polyvalent alcohol are appropriately modified, thereby allowing capability of, for example, adjusting the content of a carboxyl group at a terminal in polyester, and further allowing for denaturation of polyester thus obtained. Further, denatured polyester can be obtained also by simply introducing a carboxyl group to a main chain of polyester with use of trimellitic anhydride as a polybasic acid. Polyester having self-dispersibility in water may also be used, in which a hydrophilic group such as a carboxyl group or a sulfonic acid group is bonded to a main chain and/or a side chain of polyester. Further, polyester may be grafted with an acrylic resin.

The glass transition temperature of the binder resin is preferably 30° C. or higher and 80° C. or lower. A binder resin having a glass transition temperature lower than 30° C. easily causes the blocking in which a toner thermally aggregates inside the image forming apparatus, which may decrease preservation stability. A binder resin having a glass transition temperature exceeding 80° C. lowers the fixability of the toner onto a recording medium, which may cause fixing failure.

As the colorant, an organic dye, an organic pigment, an inorganic dye, an inorganic pigment, or the like, which is commonly used in the electrophotographic field, can be used.

Examples of a black colorant include carbon black, copper oxide, manganese dioxide, aniline black, activated carbon, non-magnetic ferrite, magnetic ferrite, and magnetite.

Examples of a yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GE, quinoline yellow lake, permanent yellow NCG, tartrazine lake, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 180, and C. I. Pigment Yellow 185.

Examples of an orange colorant include red chrome yellow, molybdenum orange, permanent orange GTR, pyrazolone orange, vulcan orange, indanthrene brilliant orange RK, benzidine orange G, indanthrene brilliant orange GK, C. I. Pigment Orange 31, and C. I. Pigment Orange 43.

Examples of a red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C. I. Pigment Red 222.

Examples of a purple colorant include manganese purple, fast violet B, and methyl violet lake.

Examples of a blue colorant include Prussian blue, cobalt blue, alkali blue lake, Victoria blue lake, phthalocyanine blue, metal-free phthalocyanine blue, phthalocyanine blue-partial chlorination product, fast sky blue, indanthrene blue BC, and C. I. Pigment Blue 15, C. I. Pigment Blue 15:2, C. I. Pigment Blue 15:3, C. I. Pigment Blue 16, C. I. Pigment Blue 60.

Examples of a green colorant include chromium green, chromium oxide, pigment green B, malachite green lake, final yellow green G, and C. I. Pigment Green 7.

Examples of a white colorant include those compounds such as zinc oxide, titanium oxide, antimony white, or zinc sulfide.

The colorants may each be used alone, or two or more of the colorants of different colors may be used in combination. Further, two or more of the colorants with the same color may be used in combination. The usage of the colorant is not particularly limited, but it is preferably 5 parts by weight or more and 20 parts by weight or less, and more preferably 5 parts by weight or more and 10 parts by weight or less, based on 100 parts by weight of the binder resin.

The colorant may be used as a masterbatch to be dispersed uniformly in the binder resin. Further, two or more of the colorants may be formed into a composite particle. The composite particle is capable of being manufactured, for example, by adding an appropriate amount of water, lower alcohol, and the like to two or more of colorants and granulating the mixture by a general granulating machine such as a high-speed mill, followed by drying. The masterbatch and the composite particle are incorporated into the toner composition at the time of dry-mixing.

The toner base particles may contain a charge control agent in addition to the binder resin and the colorant. For the charge control agent, charge control agents commonly used in this field for controlling a positive charge and a negative charge can be used.

Examples of the charge control agent for controlling a positive charge include a basic dye, a quaternary ammonium salt, a quaternary phosphonium salt, aminopyrine, a pyrimidine compound, a polynuclear polyamino compound, aminosilane, a nigrosine dye and a derivative thereof, a triphenylmethane derivative, a guanidine salt, and an amidine salt.

Examples of the charge control agent for controlling a negative charge include an oil-soluble dye such as an oil black or a spirone black, a metal-containing azo compound, an azo complex dye, a naphthene acid metal salt, a metal complex or metal salt (the metal is chrome, zinc, zirconium, or the like) of a salicylic acid and its derivative, a boron compound, a fatty acid soap, a long-chain alkyl carboxylic acid salt, and a resin acid soap. The charge control agents may be used each alone, or if needed, two or more of them may be used in combination. Although the usage of the charge control agent is not particularly limited and can be properly selected from a wide range, the amount is preferably 0.5 part by weight or more and 3 parts by weight or less based on 100 parts by weight of the binder resin.

Furthermore, the toner base particles may contain a release agent in addition to the binder resin and the colorant. As the release agent, it is possible to use ingredients which are commonly used in this field, including, for example, petroleum wax such as paraffin wax and a derivative thereof, or microcrystalline wax and a derivative thereof; hydrocarbon-based synthetic wax such as Fischer-Tropsch wax and a derivatives thereof, polyolefin wax (polyethylene wax, polypropylene wax, and the like) and a derivative thereof, low-molecular-weight polypropylene wax and a derivative thereof, or polyolefinic polymer wax (low-molecular-weight polyethylene wax, and the like) and a derivative thereof; vegetable wax such as carnauba wax and a derivative thereof, rice wax and a derivative thereof, candelilla wax and a derivative thereof, or Japan wax; animal wax such as bees wax or spermaceti wax; fat and oil-based synthetic wax such as fatty acid amides or phenolic fatty acid esters; long-chain carboxylic acids and a derivative thereof; long-chain alcohols and a derivative thereof; silicon polymers; and higher fatty acids. Examples of the derivatives include oxides, block copolymers of a vinyl-based monomer and wax, and graft-modified derivatives of a vinyl-based monomer and wax. The usage of the wax may be appropriately selected from a wide range without particularly limitation, but it is preferably 0.2 part by weight to 20 parts by weight, more preferably 0.5 part by weight to 10 parts by weight, and particularly preferably 1.0 part by weight to 8.0 parts by weight, based on 100 parts by weight of the binder resin.

The toner base particles obtained in the toner base particle producing step S1 preferably have a volume average particle size of 4 μm or more and 8 μm or less. When the volume average particle size of the toner base particles falls within a range of 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. When the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. When the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and contamination inside the apparatus due to toner scattering is likely to occur.

(2) Fine Resin Particle Preparation Step S2

In the fine resin particle preparation step S2, dried fine resin particles are prepared. For drying, any type of method may be used, and for example, a method such as heated-air direct drying, conduction heat-transfer drying, far-infrared radiation drying, or microwave radiation drying can be used to obtain dried fine resin particles. The fine resin particles are used as a resin coating layer for coating the toner base particles in the subsequent coating step S3. By coating the surfaces of the toner base particles using the resin coating layer, for example, it is possible to prevent occurrence of toner aggregation during preservation by melting of a low melting-point component such as a releasing agent contained in the toner base particle. Moreover, when the toner base particles are coated, for example, by spraying the liquid in which the fine resin particles are dispersed, the shapes of the fine resin particles are retained on the surfaces of the toner base particles. This makes it possible to obtain a toner which is superior in cleanability compared with a toner having smoothed surfaces.

The fine resin particles can be obtained for example by subjecting a resin used as a raw material for the fine resin particles to the process of emulsification and dispersion using a homogenizer or the like, followed by performing grain refinement. Alternatively it can be obtained through polymerization of resin monomer components.

As the raw materials for the fine resin particles, for example, the resins used as the toner materials can be used, and examples thereof include polyester, an acrylic resin, a styrene resin, and a styrene-acrylate copolymer.

The softening temperature of the resin that is used as a raw material for the fine resin particles is preferably higher than the glass transition temperature of the binder resin contained in the toner base particles, and more preferably 60° C. or higher. This makes it possible to prevent fusing bonding between the toners during storage for the toner manufactured by the method of the invention and to improve the preservation stability. Further, the softening temperature of the resin that is used as a raw material for the fine resin particles depends on image forming apparatuses in which the toners are used, but it is preferably 80° C. or higher and 140° C. or lower. By using the resin within these temperature ranges, a toner having both of preservation stability and fixability can be obtained.

The volume average particle size of the toner base particles needs to be sufficiently smaller than the average particle size of the toner base particles, and it is preferably 0.05 μm or more and 1 μm or less, and more preferably 0.1 μm or more and 0.5 μm or less. When the volume average particle size of the fine resin particles falls within a range of 0.05 μm or more and 1 μm or less, a projection with a suitable size is formed on the surfaces of the toner base particles, whereby the toner manufactured by the method of the invention is easily caught by cleaning blades at the time of cleaning, resulting in improvement of the cleanability.

The total addition amount of the fine resin particles is preferably 3 parts by weight or more based on 100 parts by weight of the toner base particle. If it is less than 3 parts by weight, it is hard to coat the toner base particles uniformly, and according to the kind of the toner base particles, the preservation stability may be deteriorated.

(3) Coating Step S3

<Toner Manufacturing Apparatus>

Figure 2:
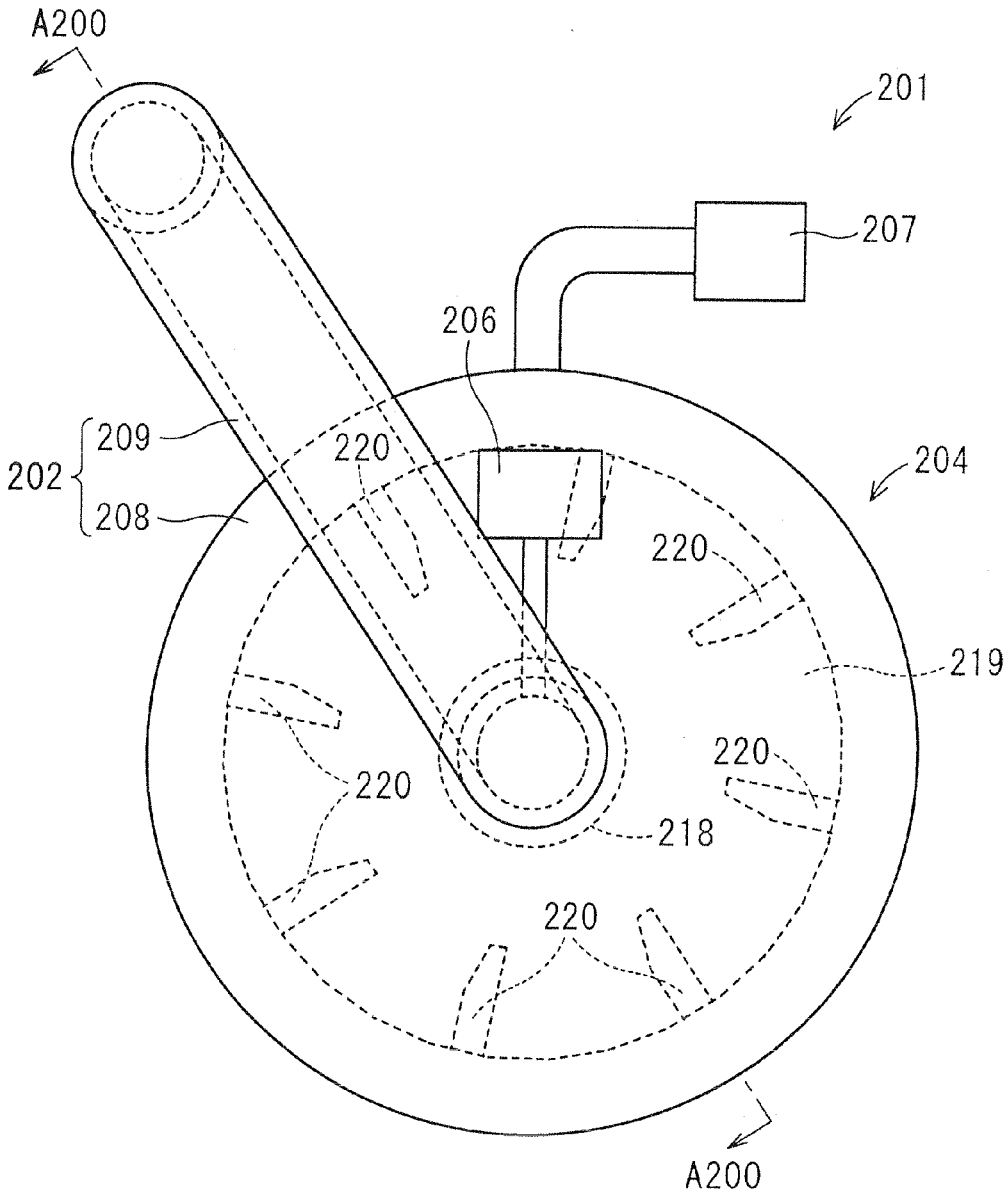
FIG. 2 is a front view showing the configuration of a toner manufacturing apparatus which is used in one example of the method for manufacturing a capsule toner of the invention.
Figure 3:
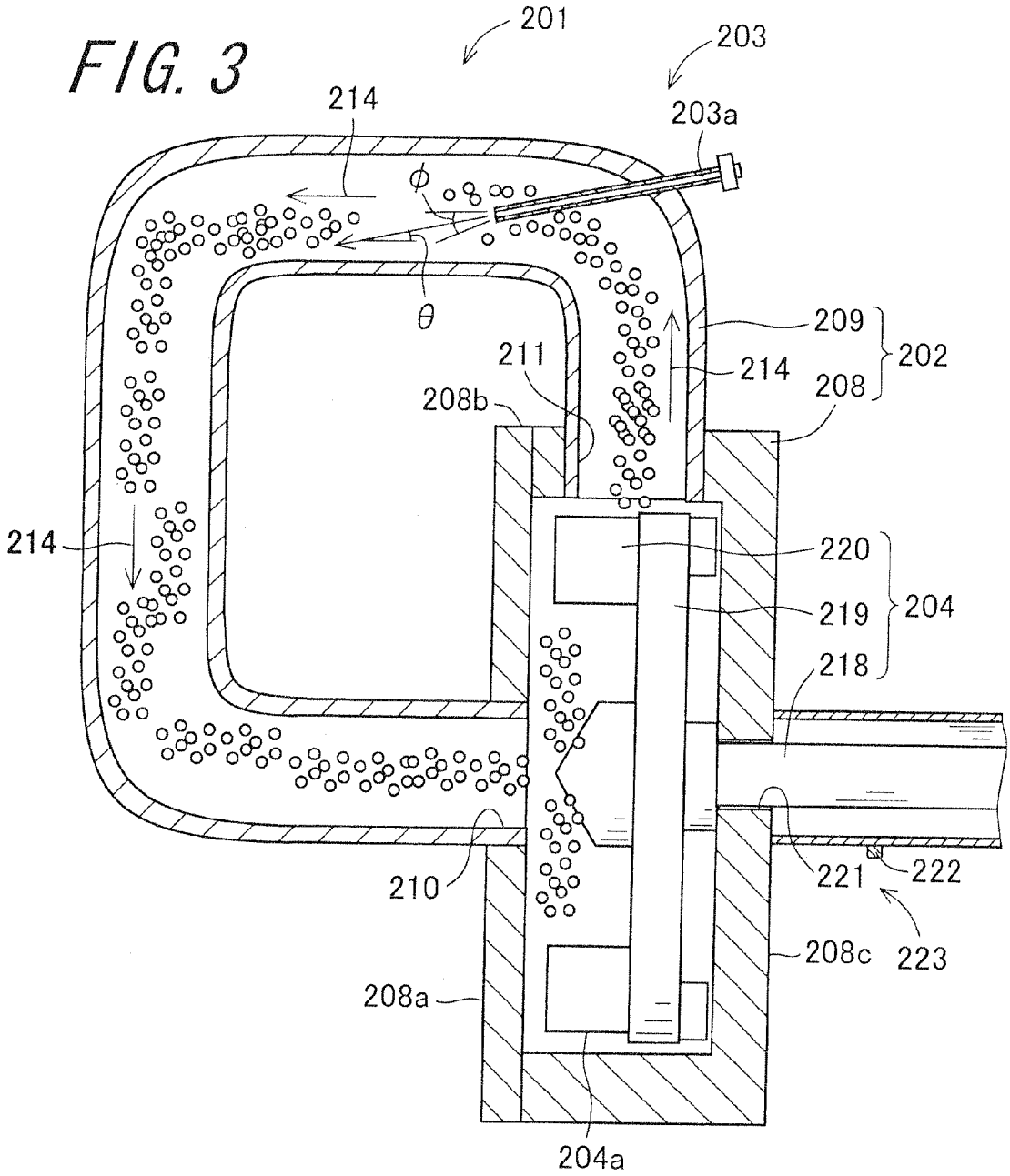
FIG. 3 is a schematic sectional view showing the toner manufacturing apparatus shown in FIG. 2 taken along the line A200-A200.

FIG. 2 is a front view showing the configuration of a toner manufacturing apparatus 201 which is used in one example of the method for manufacturing a capsule toner of the invention. FIG. 3 is a schematic sectional view showing the toner manufacturing apparatus 201 shown in FIG. 2 taken along the line A200-A200. In the coating step S3, for example, by using the toner manufacturing apparatus 201 shown in FIG. 2, the fine resin particles prepared in the fine resin particle preparation step S2 are adhered to the toner base particles produced in the toner base particle producing step S1, and a resin film is formed on the toner base particles by impact force from the synergic effect of circulation and stirring in the apparatus.

The toner manufacturing apparatus 201 is a rotary stirring apparatus, and includes a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 comprises a stirring section 208 and a powder flowing section 209. The stirring section 208 is a cylindrical container-like member having an internal space. Openings 210 and 211 are formed in the stirring section 208 which is a rotary stirring chamber. The opening 210 is formed at an approximate center part of a surface 208*a* in one side of the axial direction of the stirring section 208 so as to penetrate a side wall including the surface 208*a* of the stirring section 208 in a thickness direction thereof. Moreover, the opening 211 is formed at a side surface 208*b* perpendicular to the surface 208*a* in one side of the axial direction of the stirring section 208 so as to penetrate a side wall including the side surface 208*b* of the stirring section 208 in a thickness direction thereof. The powder flowing section 209 which is a circulating tube has one end connected to the opening 210 and the other end connected to the opening 211. Thus, the internal space of the stirring section 208 and the internal space of the powder flowing section 209 are communicated to form the powder passage 202. The toner base particles, the fine resin particles and the gas flow through the powder passage 202. The powder passage 202 is provided so that a powder flowing direction which is a direction in which the toner base particles and the fine resin particles flow is constant.

A temperature in the powder passage 202 is set at not higher than a glass transition temperature of the toner base particles, and is more preferably 30° C. or higher and not higher than a glass transition temperature of the toner base particles. The temperature in the powder passage 202 is almost uniform at any part by fluidity of the toner base particles. When the temperature in the passage exceeds the glass transition temperature of the toner base particles, there is a possibility that the toner base particles are softened excessively and aggregation of the toner base particles is generated. Further, in a case where the temperature is lower than 30° C., the drying speed of a dispersion liquid is made slow and the productivity is lowered. Accordingly, in order to prevent aggregation of the toner base particles, it is necessary that the temperature of the powder passage 202 and the rotary stirring section 204 described below, is maintained at not higher than the glass transition temperature of the toner base particles. Thus, the temperature regulation jacket described below, whose inner diameter is larger than an external diameter of the powder passage tube, is disposed at least on a part of the outside of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted into a through-hole 221 penetrating a side wall including a surface 208*c* disposed on the other side of the axial direction of the stirring section 208, in a thickness direction thereof, and that is rotated around its axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

In the coating step S3, a peripheral speed of the outermost peripheral of the rotary stirring section 204 is preferably set to 30 m/sec or more, and more preferably to 50 m/sec or more. The outermost peripheral of the rotary stirring section 204 is a part 204*a* of the rotary stirring section 204 that has the longest distance from the axis of the rotary shaft member 218 in a direction perpendicular to a direction in which the rotary shaft member 218 of the rotary stirring section 204 extends. When the peripheral speed in the outermost peripheral of the rotary stirring section 204 is set to 30 m/sec or more at the time of rotation, it is possible to isolate and fluidize the toner base particles. When the peripheral speed in the outermost peripheral is less than 30 m/sec, it is impossible to isolate and fluidize the toner base particles and the fine resin particles, thus making it impossible to uniformly coat the toner base particles with the resin film.

The toner base particles and the fine resin particles preferably collide with the rotary disc 219 perpendicularly to the disc. This makes it possible to stir the toner base particles and the fine resin particles sufficiently and coat the toner base particles with the fine resin particles more uniformly, and to further improve yield of the toner with the uniform resin coating layer.

(Spraying Section)

The spraying section 203 is provided so as to be inserted in an opening formed on the outer wall of the powder passage 202 and is arranged, in the powder flowing section 209, on the powder flowing section which is on the closest side to the opening section 211 in the flowing direction of the toner base particles and the fine resin particles.

The spraying section 203 sprays a spray liquid to the toner base particles. The spraying section 203 includes a liquid reservoir for reserving a liquid, a carrier gas feeding section for feeding a carrier gas, a two-fluid nozzle 203*a* for mixing the liquid and the carrier gas and ejecting the obtained mixture as a spray liquid to the toner base particles present in the powder passage 202, a liquid feeding pump for feeding a predetermined amount of a liquid to the two-fluid nozzle 203*a*, and an ultrasonic vibrator 203*b* for providing an ultrasonic vibration to the liquid.

As the carrier gas, compressed air or the like can be used. The liquid is supplied to the spraying section 203 by the liquid feeding pump with a constant flow rate and the sprayed liquid is spread on the surfaces of the toner base particles.

Figure 4:
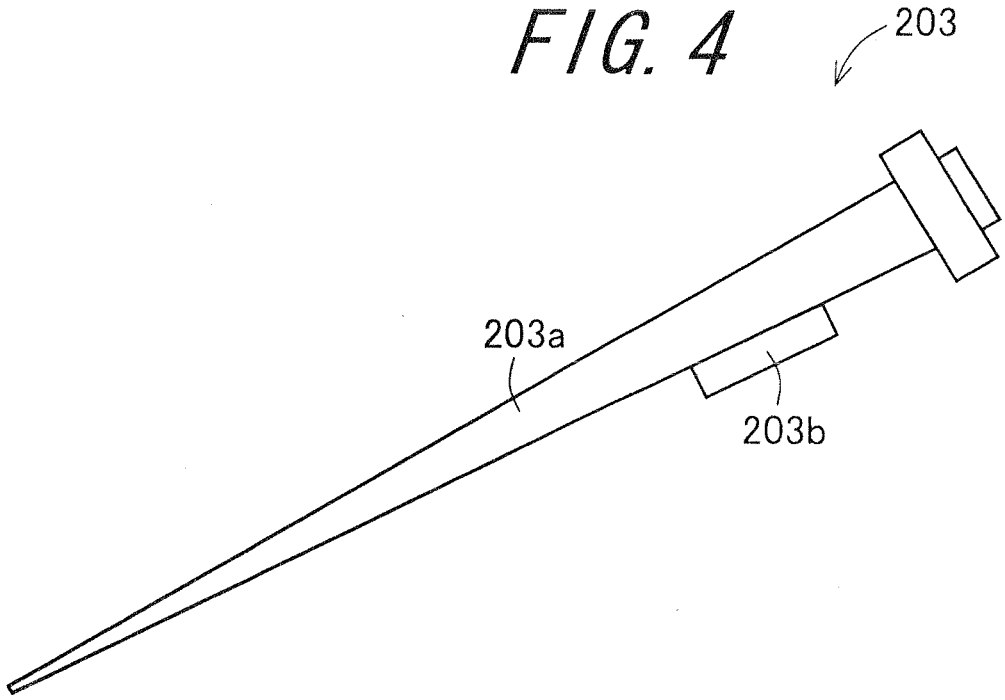
FIG. 4 is a front view showing the configuration of a spraying section.

FIG. 4 is a front view showing the configuration of the spraying section 203. By performing vibration of the ultrasonic vibrator 203*b* at 1 to 3 MHz, ultrasonic vibration is applied to the liquid immediately before being sprayed from the two-fluid nozzle 203*a*, and the liquid made into liquid-droplets is sprayed as a spray liquid from the two-fluid nozzle 203*a* together with the carrier gas.

As the ultrasonic vibrator 203*b*, a known ultrasonic vibrator can be used. In the embodiment, there is used an ultrasonic vibrator (Type: D4520) manufactured by Ngk Spark Plug Co., Ltd.

(Temperature Regulation Jacket)

The temperature regulation jacket (not shown) is provided at least on a part of the outside of the powder passage 202 and regulates a temperature in the powder passage 202 and of the rotary stirring section 204 to a predetermined temperature by passing a cooling medium or a heating medium through the space inside the jacket. This makes it possible to control the temperatures in the powder passage and the outside of the rotary stirring section at not higher than a temperature at which the toner base particles and the fine resin particles in the temperature regulation step S3*a* described below are not softened and deformed. Thus, in a spraying step S3*c* and a film-forming step S3*d*, which will be described below, a variation in the temperature applied to the toner base particles, the fine resin particles, and the liquid is reduced and this makes it possible to keep the stable fluid state of the toner base particles and the fine resin particles.

In this embodiment, the temperature regulation jacket is preferably provided over the entire outside of the powder passage 202. Although the toner base particles and the fine resin particles generally collide with the inner wall of the powder passage many times, a part of the collision energy is converted into the thermal energy at the time of collision and is accumulated in the toner base particles and the fine resin particles. As the number of collisions increases, the thermal energy accumulated in the particles increases and then the toner base particles and the fine resin particles are softened to be adhered to the inner wall of the powder passage. By providing the temperature regulation jacket over the entire outside of the powder passage 202, an adhesive force of the toner base particles and the fine resin particles is reduced to the inner wall of the powder passage, it is possible to prevent adhesion of the toner base particles to the inner wall of the powder passage 202 due to a sudden rise of the temperature in the apparatus reliably and to avoid the inside of the powder passage being narrowed by the toner base particles and the fine resin particles. Accordingly, the toner base particles are coated with the fine resin particles uniformly and it is possible to manufacture a toner having excellent cleanability at high yield.

Furthermore, in the inside of the powder flowing section 209 downstream of the spraying section 203, the sprayed liquid is not dried and remains therein. Where the temperature is not appropriate, the drying speed becomes slow, and the liquid easily remains. Where the toner base particles are in contact with the residual liquid, the toner base particles are easily adhered to the inner wall of the powder passage 202. This may be the generation source of aggregation of the toner. On the inner wall in the vicinity of the opening 210, the toner base particles flowing into the stirring section 208 collide with the toner base particles fluidized in the stirring section 208 by the stirring with the rotary stirring section 204. Due to this, the toner base particles collided easily adhere to the vicinity of the opening 210. Therefore, adhesion of the toner base particles to the inner wall of the powder passage 202 can be further securely prevented by providing the temperature regulation jacket in an area to which the toner base particles easily adhere.

(Powder Inputting Section and Powder Collecting Section)

Figure 5:
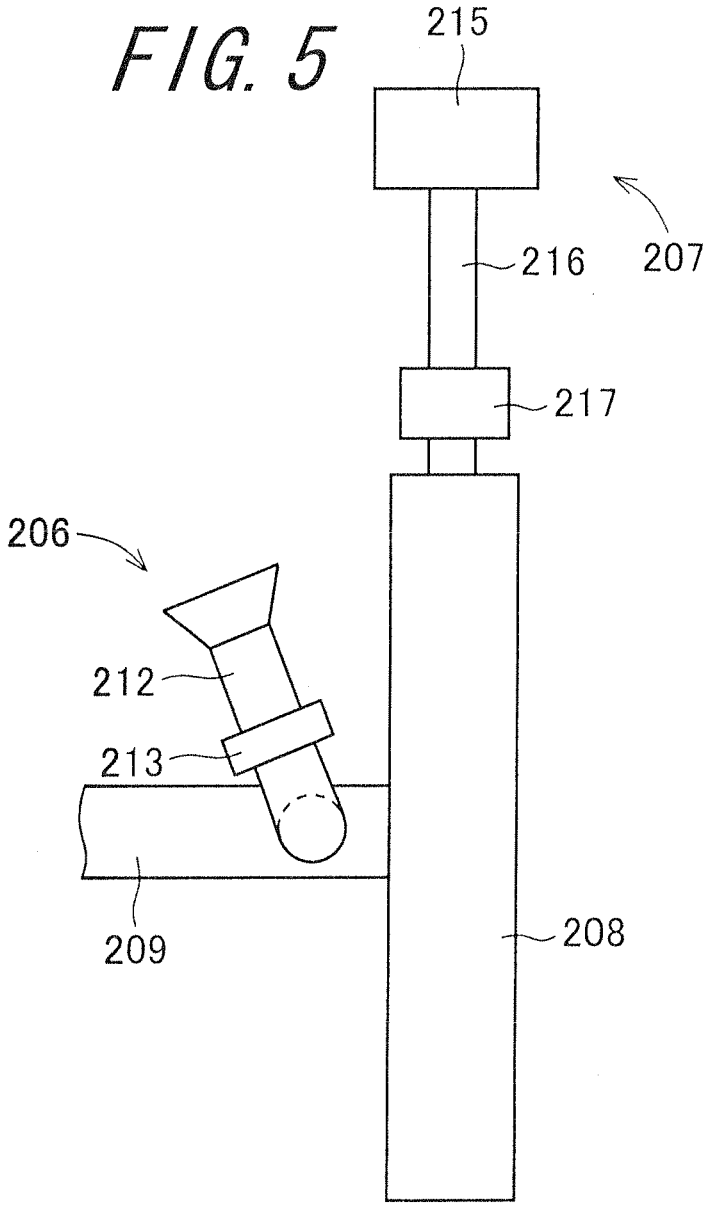
FIG. 5 is a side view of a configuration around a powder inputting section and a powder collecting section.

The powder flowing section 209 of the powder passage 202 is connected to the powder inputting section 206 and the powder collecting section 207. FIG. 5 is a side view of a configuration around the powder inputting section 206 and the powder collecting section 207.

The powder inputting section 206 includes a hopper (not shown) that feeds the toner base particles and the fine resin particles, a feeding tube 212 that communicates the hopper and the powder passage 202, and an electromagnetic valve 213 provided in the feeding tube 212. The toner base particles and the fine resin particles fed from the hopper are fed to the powder passage 202 through the feeding tube 212 in a state where the passage in the feeding tube 212 is opened by the electromagnetic valve 213. The toner base particles and the fine resin particles fed to the powder passage 202 flow in the constant powder flowing direction with stirring by the rotary stirring section 204. Moreover, the toner base particles and the fine resin particles are not fed to the powder passage 202 in a state where the passage in the feeding tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

The coating step S3 using the toner manufacturing apparatus 201 as described above includes a temperature regulation step S3*a*, a fine resin particle adhering step S3*b*, a spraying step S3*c*, a film-forming step S3*d*, and a collecting step S3*e*.

(3)-1 Temperature Regulation Step S3*a*

In the temperature regulation step S3*a*, while the rotary stirring section 204 is rotated, a temperature in the powder passage 202 and the rotary stirring section 204 is regulated to a predetermined temperature by passing a medium through the temperature regulation jacket disposed on the outside thereof. This makes it possible to control the temperature in the powder passage 202 at not higher than a temperature at which the toner base particles and the fine resin particles that are inputted in the fine resin particle-adhering step described below are not softened and deformed.

(3)-2 Fine Resin Particle Adhering Step S3*b*

In the fine resin particle adhering step S3*b*, the toner base particles and the fine resin particles are fed from the powder inputting section 206 to the powder passage 202 in a state where the rotary shaft member 218 of the rotary stirring section 204 is being rotated.

The toner base particles and the fine resin particles fed to the powder passage 206 are stirred by the rotary stirring section 204 to flow through the powder flowing section 209 of the powder passage 202 in the direction indicated by an arrow 214. This makes the fine resin particles adhere to the surfaces of the toner base particles.

(3)-3 Spraying Step S3*c*

In the spraying step S3*c*, a liquid having an effect of not dissolving but plasticizing the toner base particles and the fine resin particles is sprayed from the spraying section 203 by a carrier gas, while fluidizing the toner base particles and the fine resin particles.

As a liquid having an effect of not dissolving but plasticizing the toner base particles and the fine resin particles, it is not particularly limited, but it is preferably an easily evaporated liquid since its removal from the toner base particles and the mixed fine resin particles is necessary after spraying the liquid. Examples of such a liquid include a liquid containing a lower alcohol. Examples of the lower alcohol include methanol, ethanol, propanol, and the like. When the liquid includes such a lower alcohol, it is possible to enhance wettability of the mixed fine resin particles as a coating material with respect to the toner base particles, and the fine resin particles are adhered over the entire surface or a large part of the toner base particles, which easily allows further deformation and film formation. In addition, since the lower alcohol has a high vapor pressure, it is possible to further shorten the drying time at the time of removing the liquid and to suppress aggregation between the toner particles.

Further, the viscosity of the liquid to be sprayed is preferably 5 cP or less. The viscosity of the liquid is measured at 25° C., and can be measured, for example, by a cone-plate type rotation viscometer. A preferable example of the liquid having the viscosity of 5 cP or less includes alcohol. Examples of the alcohol include methyl alcohol and ethyl alcohol. These alcohols have low viscosity and are easily vaporized, and therefore, when the liquid includes the alcohol, it is possible to spray the liquid with a minute liquid-droplet diameter without increasing a diameter of the spray liquid-droplet of the liquid to be sprayed from the spraying section 203. It is also possible to spray the liquid with a uniform liquid-droplet diameter. It is possible to further promote fining of the liquid-droplet at the time of collision of the toner base particles and the liquid-droplet. This makes it possible to obtain a coated toner having excellent uniformity by uniformly wetting the surfaces of the toner base particles and the fine resin particles with the liquid and applying the liquid to the surfaces of the toner base particles and the fine resin particles and softening the fine resin particles by a synergic effect with collision energy. As a result, a resin coating toner with excellent uniformity can be obtained.

The liquid to be sprayed is provided with ultrasonic vibration by the ultrasonic vibrator 203*b* for making fine liquid-droplets. The number average liquid-droplet diameter of the liquid to be sprayed is preferably less than 10 μm, and more preferably less than 5 μm. When the number average liquid-droplet diameter of the liquid to be sprayed has such a size, the toner base particles and the fine resin particles flowing in the powder passage 202 are suppressed from aggregating and adhering on the inner wall of the passage, and also, the spray liquid can be spread uniformly on these particles. The size of the number average liquid-droplet diameter can be regulated by varying the frequency of the provided ultrasonic vibration.

The sprayed liquid is gasified so that the inside of the powder passage 202 has a constant gas concentration and the gasified liquid is preferably ejected outside the powder passage through the through-hole 221. This makes it possible to keep the concentration of the gasified liquid in the powder passage 202 constant and to make the drying speed of the liquid higher than the case where the concentration is not kept constant. Accordingly, it is possible to prevent adherence of the toner particles in which undried liquid remains to other toner particles and to further suppress aggregation of the toner particles. As a result, it is possible to further improve the yield of the toner with the uniform resin coating layer.

The concentration of the gasified liquid measured by a concentration sensor in a gas exhausting section 222 is preferably around 3% by weight or less. When the concentration of the gasified liquid is around 3% by weight or less, the drying speed of the liquid is able to be increased sufficiently, thus making it possible to prevent adhesion of the undried toner particles in which there is remaining liquid to other toner particles and to prevent aggregation of the toner particles. Moreover, the concentration of the gasified liquid is more preferably 0.1% by weight or more and 3.0% by weight or less. When the concentration falls within this range, it is possible to prevent aggregation of the toner particles without deteriorating the productivity.

In the embodiment, spraying is preferably initiated after fluidizing rate of the toner base particles and the fine resin particles are stabilized in the powder passage 202. This allows uniform spraying of the liquid to the toner base particles and the fine resin particles and can improve the yield of a toner with the uniform resin coating layer.

(3)-4 Film-Forming Step S3*d*

In the film-forming step S3*d*, until the fine resin particles adhered to the toner base particles are softened to form a film, stirring of the rotary stirring section 204 is continued at a predetermined temperature and the toner base particles are coated with resin coating layers to make a capsule toner.

(3)-5 Collecting Step S3*e*

In the collecting step S3*e*, spraying of the liquid from the spraying section and rotation of the rotary stirring section 204 are stopped, and the capsule toner is ejected outside the apparatus from the powder collecting section 207, and thus collected.

The configuration of the toner manufacturing apparatus 201 is not limited to the above and various alterations may be added thereto. For example, the temperature regulation jacket may be provided over the entire outside of the powder flowing section 209 and the stirring section 208, or may be provided in a part of the outside of the powder flowing section 209 or the stirring section 208. When the temperature regulation jacket is provided over the entire outside of the powder flowing section 209 and the stirring section 208, it is possible to prevent the toner base particles from being adhered to the inner wall of the powder passage 202 more reliably.

Furthermore, the toner manufacturing apparatus as described above can be also obtained by combining a commercially available stirring apparatus and the spraying section. An example of the commercially available stirring apparatus provided with a powder passage and a rotary stirring section includes a Hybridization system (trade name, manufactured by Nara Machinery Co., Ltd.) By installing a liquid spraying unit in the stirring apparatus, the stirring apparatus is usable as the toner manufacturing apparatus for the preparation of the capsule toner of the invention.

2. Toner

The toner according to an embodiment of the invention is manufactured by the above-described method for manufacturing a capsule toner. The toner manufactured by the above-described method for manufacturing a capsule toner has uniform thickness of the coating layers due to the fine resin particles, and thus, the toner characteristics become uniform among the individual toner particles. Accordingly, the stability at a high temperature is excellent and the fixability is also improved. Further, by performing image formation with the use of such a toner, it is possible to form a good-quality image which exhibits high resolution and is free from density unevenness.

An external additive may be added to the toner of the invention. As the external additive, a known one can be used, and examples thereof include silica and titanium oxide. Further, it is preferable that these substances is surface-treated with a silicon resin, a silane coupling agent, or the like. The usage of the external additive is preferably 1 part by weight to 10 parts by weight based on 100 parts by weight of the toner.

3. Developer

A developer according to an embodiment of the invention includes the toner according to the above embodiment. Since the toner characteristic of the developer can be made uniform, a developer capable of retaining a good developability can be obtained. The developer of the embodiment can be used in the form of either a one-component developer or a two-component developer. When the developer is used in the form of the one-component developer, the toner is used alone without a carrier. A blade and a fur brush are used to effect the frictional electrification on a developing sleeve so that the toner is attached onto the sleeve, thereby conveying the toner to perform image formation. When the developer is used in the form of a two-component developer, the toner of the above embodiment is used together with a carrier.

As the carrier, a known one can be used, and examples thereof include single or complex ferrite composed of iron, copper, zinc, nickel, cobalt, manganese, chromium, or the like; a resin-coated carrier having carrier core particles whose surfaces are coated with coating materials; and a resin-dispersion type carrier in which magnetic particles are dispersed in a resin.

As the coating material, a known one can be used, and examples thereof include polytetrafluoroethylene, a monochlorotrifluoroethylene polymer, polyvinylidene fluoride, a silicon resin, a polyester resin, a metal compound of di-tertiary-butylsalicylic acid, a styrene resin, an acrylic resin, a polyamide, polyvinyl butyral, nigrosine, an aminoacrylate resin, basic dyes or lakes thereof, fine silica powders, and fine alumina powders. In addition, the resin used for the resin-dispersion type carrier is not particularly limited, and examples thereof include a styrene-acrylic resin, a polyester resin, a fluorine resin, and a phenol resin. Both of the coating materials are preferably selected according to the toner components, and these may be used each alone, or two or more of them may be used in combination.

The carrier preferably has a spherical shape or a flattened shape. The particle size of the carrier is not particularly limited, and in consideration of forming higher-quality images, the particle size of the carrier is preferably 10 μm to 100 μm, and more preferably 20 μm to 50 μm. Further, the resistivity of the carrier is preferably $10^8$ Ω·cm or more, and more preferably $10^{12}$ Ω·cm or more.

The volume resistivity of the carrier is a value obtained from a current value determined as follows. The carrier particles are put into a container having a cross-sectional area of 0.50 $cm^2$, and then tapped. Subsequently, a load of 1 $kg/cm^2$ is applied by use of a weight to the particles which are held in the container. When an electric field of 1000 V/cm is generated between the weight and a bottom electrode of the container by application of voltage, a current value is read. When the resistivity of the carrier is low, an electric charge will be injected into the carrier upon application of bias voltage to a developing sleeve, thus causing the carrier particles to be more easily attached to the photoreceptor. Further, breakdown of the bias voltage is more liable to occur.

The magnetization intensity (maximum magnetization) of the carrier is preferably 10 emu/g to 60 emu/g, and more preferably 15 emu/g to 40 emu/g. Under the condition of the ordinary magnetic flux density of the developing roller, a magnetic binding force does not work at a magnetization intensity of less than 10 emu/g, which may cause the carrier to spatter. Further, the carrier having a magnetization intensity of more than 60 emu/g has bushes which are too large to keep the non-contact state of the image bearing member with the toner in the non-contact development and possibly causes sweeping streaks to easily appear on a toner image in the contact development.

The use ratio of the toner to the carrier in the two-component developer is not particularly limited, and is appropriately selected according to kinds of the toner and the carrier. For example, when mixing with the resin-coated carrier (a density of 5 $g/cm^2$ to 8 $g/cm^2$), the usage of the toner may be determined such that a content of the toner in the developer is 2% by weight to 30% by weight, and preferably 2% by weight to 20% by weight of the total amount of the developer. Further, the coverage of the carrier with the toner is preferably 40% by weight to 80% by weight.

EXAMPLES

Hereinafter, the invention will be specifically described with reference to Examples and Comparative Examples below. In the following description, unless otherwise noted, "parts" and "%" represent "parts by weight" and "% by weight" respectively. In Examples and Comparative Examples, a softening temperature and a glass transition temperature of the resin, a melting point of the release agent, a volume average particle size of the toner base particles and the fine resin particles, and a number average liquid-droplet diameter of the spray liquid were measured as follows.

[Glass Transition Temperature of Resin]

Using a differential scanning calorimeter (trade name: DSC220, manufactured by Seiko Instruments & Electronics Ltd.), 1 g of a specimen was heated at a rate of temperature increase of 10° C./min to measure a DEC curve in accordance with Japanese Industrial Standards (JIS) K7121-1987. In the obtained DEC curve, a temperature at an intersection of a straight line that was elongated toward a low-temperature side from a base line on the high-temperature side of an endothermic peak corresponding to glass transition and a tangent line that was drawn so that a gradient thereof was maximum against a curve extending from a rising part to a top of the peak was obtained as the glass transition temperature (Tg).

[Softening Temperature of Resin]

Using a flow characteristic evaluation apparatus (trade name: FLOW TESTER CFT-100C, manufactured by Shimadzu Corporation), 1 g of a specimen was heated at a rate of temperature increase of 6° C./min under a load of 20 $kgf/cm^2$ (19.6×10 Pa) so that the specimen was pushed out of a dye (a nozzle aperture of 1 mm and a length of 1 mm) and a temperature at the time when a half amount of the specimen had flowed out of the dye was obtained as the softening temperature (Tm).

[Melting Point of Release Agent]

Using a differential scanning calorimeter (trade name: DSC220, manufactured by Seiko Instruments & Electronics Ltd.), 1 g of a specimen was heated from 20° C. to 200° C. at a rate of temperature increase of 10° C./min, and then an operation of rapidly cooling down from 200° C. 20° C. was repeated twice, thus measuring a DSC curve. A temperature of an endothermic peak corresponding to the melting on the DSC curve measured at the second operation was obtained as the melting point of the release agent.

[Volume Average Particle Sizes of Toner Base Particles and Fine Resin Particles]

To 50 ml of an electrolyte (trade name: ISOTON-II, manufactured by Beckman Coulter, Inc.), 20 mg of a specimen and 1 ml of sodium alkyl ether sulfate were added, and the mixture was subjected to a dispersion treatment with an ultrasonic distributor (trade name: Desktop Two-Frequency Ultrasonic Cleaner VS-D100, manufactured by AS ONE Corporation) for 3 minutes at an ultrasonic frequency of 20 kHz, thereby preparing a specimen for measurement. The measurement sample was analyzed by a particle size distribution-measuring apparatus: MULTISIZER 3 (trade name) manufactured by Beckman Coulter, Inc. under the conditions that an aperture diameter was 100 μm and the number of particles for measurement was 50000 counts. A volume average particle size was determined from the volume particle size distribution of the sample particles.

[Number Average Droplet Diameter of Spray Liquid]

The number average droplet diameter was measured by using a particle size distribution measuring apparatus (trade name: VisiSizer SH, manufactured by Japan Laser Corp.). The spraying section 203 was taken out of the toner manufacturing apparatus 201, and a spray liquid was sprayed thereto between a high-resolution camera and an irradiation light source (laser) in the same manner as in the spraying step. The image obtained by laser irradiation (radiation time: 1 μs) was photographed using the high-resolution camera (resolution 1600×1200 DPI). The obtained image was analyzed with an image analysis software (VisiSizer Particle Measuring Software) to give a number average particle size of 5000 spray liquid-droplets as a number average liquid-droplet diameter of the spray liquid.

Example 1

| [Toner base particle producing step S1] | |
|---|---|
| Polyester resin (trade name: DIACRON, manufactured by Mitsubishi Rayon Co., Ltd., a glass transition temperature of 55° C., and a softening temperature of 130° C.) | 90.0% |
| C.I. Pigment Blue 15:3 | 4.0% |
| Release agent (Paraffin wax, a melting point of 75° C.) | 5.0% |
| Charge control agent (trade name: Bontron E84, manufactured by Orient Chemical Industries Co., Ltd.) | 1.0% |

After pre-mixing the raw materials described above by a Henschel mixer (trade name: FM20C, manufactured by Mitsui Mining Co., Ltd.), the obtained mixture was melt-kneaded by KNEADEX (manufactured by Mitsui Mining Co., Ltd.) at 140° C. After coarsely pulverizing the melt-kneaded product by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to produce toner base particles having a volume average particle size of 6.7 μm, a glass transition temperature of 54° C., and a softening temperature of 121° C.

[Fine Resin Particle Preparation Step S2]

A product of polymerization of styrene and butyl acrylate was freeze-dried to obtain styrene butyl acrylate copolymer fine resin particles having a volume average particle size of 0.1 μm (a glass transition temperature of 61° C. and a softening temperature of 110° C.)

[Coating Step S3]

By a Hybridization system (trade name: NHS-1 Model, manufactured by Nara Machinery Co., Ltd.) in accordance with the apparatus in FIG. 2, 100 parts of the toner base particles and 5 parts of the fine resin particles were stirred and fluidized for 5 minutes, and ethanol afforded with ultrasonic vibration at a frequency of 2.0 MHz (the number average liquid-droplet diameter of 4.5 μm) was sprayed thereon by a spraying section 203.

The temperature regulation jacket was provided over the entire surface of the powder flowing section and the wall surface of the stirring section. A temperature sensor was installed in the powder passage so that a temperature of the powder flowing section and the stirring section became 55° C. In the above-described apparatus, a peripheral speed in the outermost peripheral of the rotary stirring section of the Hybridization system was 100 m/sec in the step of adhering the fine resin particle to the surfaces of the toner base particles. The peripheral speed was also 100 m/sec in the spraying step and the film-forming step.

Moreover, an installation angle of the two-fluid nozzle was set so that an angle formed by the liquid spraying direction and the powder flowing direction (hereinafter referred to as "spraying angle") is in parallel (0°).

Ethanol was sprayed at a spraying speed of 0.5 g/min and an air flow of 5 L/min for 30 minutes, the fine resin particles were subjected to film formation on the surfaces of the toner base particles. Then, spraying of ethanol was stopped, followed by stirring for 5 minutes, to obtain a capsule toner of Example 1. At this time, the air flow into the apparatus was set to 10 L/min in total with the air flow from the two-fluid nozzle by adjusting the air flow from the rotary shaft section into the apparatus to 5 L/min.

To the capsule toner thus produced, an external additive was externally added. To 100 parts by weight of the capsule toner, 2.2 parts in total of 1.2 parts of hydrophobic silica (trade name: R-974, manufactured by Nippon Aerosil Co., Ltd.) as the external additie and 1.0 part of hydrophobic titanium (trade name: T-805, manufactured by Nippon Aerosil Co., Ltd.) were added and mixed by a Henschel mixer (trade name: FM MIXER, manufactured by Mitsui Mining Co., Ltd.) to obtain a toner of Example 1.

[Production of Two-Component Developer]

With use of a ferrite core carrier having a volume average particle size of 45 μm as a carrier, the carrier was mixed with the toner for 20 minutes by means of a V-type mixer (trade name: V-5, manufactured by Tokuju Corporation) so that the coverage of the toner over the carrier became 60%. Thus, a two-component developer including the toner of Example 1 was produced.

Example 2

A toner and a developer of Example 2 were produced in the same manner as in Example 1 except that in the coating step S3, the frequency for ultrasonic vibration was changed to 1.2 MHz and the number average liquid-droplet diameter of ethanol was changed to 6.0 μm.

Example 3

A toner and a developer of Example 3 were produced in the same manner as in Example 1 except that in the coating step S3, the frequency for ultrasonic vibration was changed to 0.9 MHz and the number average liquid-droplet diameter of ethanol was changed to 9.5 μm.

Example 4

A toner and a developer of Example 4 were produced in the same manner as in Example 1 except that in the coating step S3, the frequency for ultrasonic vibration was changed to 3.2 MHz and the number average liquid-droplet diameter of ethanol was changed to 1.5 μm.

Example 5

A toner and a developer of Example 5 were produced in the same manner as in Example 1 except that in the coating step S3, methanol was used instead of ethanol as a spray liquid.

Comparative Example 1

A toner and a developer of Comparative Example 1 were produced in the same manner as in Example 1 except that in the coating step S3, a spraying section in which a liquid feeding pump (trade name: SP11-12, manufactured by Fromm Packaging Systems Inc.) and a two-fluid nozzle are connected was used, ultrasonic vibration was not applied, and ethanol (a number average liquid-droplet diameter of 12 μm) was sprayed.

Comparative Example 2

A toner and a developer of Comparative Example 2 were produced in the same manner as in Example 1 except that in the coating step S3, the frequency for ultrasonic vibration was changed to 0.8 MHz and the number average liquid-droplet diameter of ethanol was changed to 10 μm.

Comparative Example 3

A toner and a developer of Comparative Example 3 were produced in the same manner as in Example 1 except that in the coating step S3, ethanol was not sprayed.

Comparative Example 4

With the toner base particles alone, while not carrying out the fine resin particle preparation step S2 and the coating step S3, a toner and a developer of Comparative Example 4 were produced.

Evaluations were carried out for the obtained toners of Examples 1 to 5 and Comparative Examples 1 to 4 in the following manner.

[Yield]

The yield of the toner was calculated by the following expression and evaluated in accordance with the following criteria.

$$\text{Yield of toner (\%)}=\{\text{Weight of toner collected}/(\text{Amount of toner base particles inputted Amount of fine resin particles inputted})\}\times 100$$

Excellent (Very favorable): The yield of the toner is 95% or more.

Good (Favorable): The yield of the toner is 90% or more and less than 95%.

Not bad (Slightly not favorable): The yield of the toner is 80% or more and less than 90%.

Poor (No good): The yield of the toner is less than 80%.

[Coating Layer Uniformity]

The state of the resin coating layer was observed with an electron microscope and the uniformity was evaluated.

A cured product was prepared by embedding the toner particles in a cold setting epoxy resin. This solidified cured product was cut into plural ultrathin slices (about 100 nm) by means of a microtome having a diamond cutting edge and dyed with ruthenium. These slices were observed at a magnification of 20,000 by means of a transmission type electron microscope (trade name: H-8100, manufactured by Hitachi, Ltd.) to photograph the cross-section of the toner particle. The resin coating layer was dyed, and thus, the film state thereof could be clearly recognized and discriminated from the toner base particles. Accordingly, the film thickness of the resin coating layer coating the toner base particles was measured using image analysis software.

The film thickness of the resin coating layer was shown as an average value of the values obtained by drawing 36 straight lines per 10 angle degrees from the centers of the toner particles in a radiation pattern and measuring dimensions perpendicularly with respect to the resin coating layer from an intersection between the straight line and the resin coating layer.

The evaluation criteria for the film thickness are as follows.

Excellent (Very favorable): The thickness is 0.07 μm or more and less than 0.15 μm.

Good (Favorable): The thickness is 0.05 μm or more and less than 0.07 μm, or 0.15 μm or more and 0.2 μl or less.

Poor (No good): The thickness is less than 0.05 μm or more than 0.2 μm.

Next, among the measured values, five low values in series were selected from a lowest value to calculate an average value A, and five high values in series were selected from a highest value to calculate an average value B. A value obtained by dividing B by A was taken as a thickness difference, and evaluation was conducted in accordance with the following criteria.

Excellent (Very favorable): B/A is less than 1.5.

Good (Favorable): B/A is 1.5 or more and less than 2.

Not bad (Slightly not favorable): B/A is 2 or more and less than 2.5.

Poor (No good): B/A is 2.5 or more.

The evaluations of the film thickness and the thickness difference were combined, and the uniformity of the resin coating layer was evaluated.

Excellent (Very favorable): All of the evaluations are considered as "Excellent".

Good (Favorable): At least one or all of the evaluations are considered as "Good", but no evaluations are considered as "Poor".

Poor (No good): Either of the evaluations is considered as "Poor".

[Image Stability]

Commercially-available copiers (trade name: MX 4500, manufactured by Sharp Corporation) were filled with the two-component developers obtained Examples 1 to 5, and Comparative examples 1 to 4, respectively, and then operated to print images in the condition that an amount of the toner to be attached onto a photoreceptor was adjusted to 0.4 mg/cm$^2$. An initial image density ($ID_0$) and an image density ($ID_{10k}$) after 10,000 (hereinafter referred to as "10k") sheet-printing, were measured by a calorimeter (trade name: X-Rite 938, manufactured by X-Rite Inc.).

The image stability rate was calculated by the following formula and the image stability was evaluated by the following manner based on the obtained value.

$$\text{Image stability rate (\%)} = (ID_{10k}/ID_0) \times 100$$

Excellent (Very favorable): The image stability rate is 95% or more.

Good (Favorable): The image stability rate is 90% or more and less than 95%.

Not bad (Slightly not favorable): The image stability rate is 80% or more and less than 90%.

Poor (No good): The image stability rate is less than 80%.

[Fixability]

Using remodeled apparatuses of commercially-available copiers (trade name: MX-4500, manufactured by Sharp Corporation), fixed images were formed by the two-component developers obtained in Examples 1 to 5 and Comparative examples 1 to 4. First, unfixed images were formed on recording sheets that were recording mediums (trade name: PPC sheets SF-4AM3, manufactured by Sharp Corporation), from sample images each containing a solid image part (rectangular shape of 20 mm in height by 50 mm in width) so that an amount of the solid image part to be attached to the recording sheet was adjusted to be 0.5 mg/cm$^2$. Then, fixed images were formed by use of an external fixing device using a fixing section of a color multifunctional peripheral. A fixing processing speed was set at 124 mm/sec and a temperature of a fixing roller was increased from 130° C. by 5° C., and a temperature region causing neither a high-temperature offset nor a low-temperature offset was measured, and the temperature width was taken as a fixing non-offset region. In the embodiment, the high-temperature offset and the low-temperature offset were defined, respectively, as a state where the toner was unfixed on the recording sheet during the fixing and attached to another a recording sheet after the fixing roller rotated one revolution with the toner remained attaching the fixing roller.

The fixability was evaluated in accordance with the following criteria by the fixing non-offset region.

Excellent (Very favorable): The fixing non-offset region covers 50° C. or higher.

Good (Favorable): The fixing non-offset region covers 35° C. or higher and lower than 50° C.

Not bad (Slightly not favorable): The fixing non-offset region covers 25° C. or higher and lower than 35° C.

Poor (No good): The fixing non-offset region covers lower than 25° C.

[Comprehensive Evaluation]

Based on evaluation of the yield, the coating layer uniformity, the image stability, and the fixability, comprehensive evaluation of the capsule toner by the method for preparing a capsule toner of the invention was conducted. The evaluation criteria were as follows.

Excellent (Very favorable): All of the evaluations are considered as "Excellent".

Good (Favorable): All of the evaluations are considered as "Excellent" or "Good".

Not bad (Slightly not favorable): At least one of the evaluations is considered as "Not bad", but no evaluations are considered as "Poor".

Poor (No good): At least one of the evaluations is considered as "Poor", or all of the evaluations are considered as "Not bad".

The spray liquids used for preparation of the toners of Examples 1 to 5 and Comparative Examples 1 to 4 are shown in Table 1 and the evaluation results of each toners are shown in Table 2.

TABLE 1

| | Spray liquid | Liquid-droplet diameter [μm] |
|---|---|---|
| Example 1 | Ethanol | 4.5 |
| Example 2 | Ethanol | 6 |
| Example 3 | Ethanol | 9.5 |
| Example 4 | Ethanol | 1.5 |
| Example 5 | Methanol | 4.5 |
| Comparative Example 1 | Ethanol | 12 |
| Comparative Example 2 | Ethanol | 10 |
| Comparative Example 3 | None | None |
| Comparative Example 4 | — | — |

TABLE 2

| | Yield | | Film thickness | | Thickness difference | | Coating layer uniformity | Image stability | | Fixability | | |
|---|---|---|---|---|---|---|---|---|---|---|---|---|
| | Yield (%) | Evaluation | [μm] | Evaluation | [B/A] | Evaluation | Evaluation | Image stability rate (%) | Evaluation | fixing non offset region | Evaluation | Comprehensive evaluation |
| Ex. 1 | 97 | Excellent | 0.1 | Excellent | 1.4 | Excellent | Excellent | 98 | Excellent | 55 | Excellent | Excellent |
| Ex. 2 | 94 | Good | 0.12 | Excellent | 1.6 | Good | Good | 96 | Excellent | 55 | Excellent | Good |
| Ex. 3 | 92 | Good | 0.14 | Excellent | 1.7 | Good | Good | 97 | Excellent | 55 | Excellent | Good |
| Ex. 4 | 98 | Excellent | 0.09 | Excellent | 1.3 | Excellent | Excellent | 97 | Excellent | 55 | Excellent | Excellent |
| Ex. 5 | 97 | Excellent | 0.1 | Excellent | 1.4 | Excellent | Excellent | 96 | Excellent | 55 | Excellent | Excellent |
| Comp. Ex. 1 | 85 | Not bad | 0.16 | Good | 2.1 | Not bad | Good | 93 | Good | 55 | Excellent | Not bad |
| Comp. Ex. 2 | 89 | Not bad | 0.15 | Good | 1.9 | Good | Good | 95 | Excellent | 55 | Excellent | Not bad |
| Comp. Ex. 3 | 99 | Excellent | 0.16 | Good | 3.0 | Poor | Poor | 76 | Poor | 55 | Excellent | Poor |
| Comp. Ex. 4 | — | — | — | — | — | — | — | 58 | Poor | 55 | Excellent | Poor |

The yields of the toners of Examples 1 to 5 were all "Excellent" or "Good", and the comprehensive evaluation was also "Excellent" or "Good".

The yields of the toners of Comparative Examples 1 and 2 were all "Not bad". This is attributed to a fact that aggregation in the apparatus or installation in the inner wall was generated due to a large number average liquid-droplet diameter of the spray liquid used of 10 or more.

The yield and the fixability of the toner of Comparative Example 3 were "Excellent", but the coating layer uniformity and the image stability were "Poor", and thus, the comprehensive evaluation was considered as "Poor". This is attributed to a fact that a spray liquid was not used and thus the fine resin particles were not uniformly subjected film formation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a capsule toner, comprising:

a fine resin particle adhering step of adhering fine resin particles to surfaces of toner base particles;

a spraying step of spraying a spray liquid for plasticizing the toner base particles and the fine resin particles, while fluidizing the toner base particles and the fine resin particles; and a film-forming step of fluidizing the toner base particles and the fine resin particles until the fine resin particles adhered to the surfaces of the toner base particles are softened and form a film, in the spraying step, ultrasonic vibration being applied to set a number average liquid-droplet diameter of the spray liquid to less than 10 μm.

2. The method of claim 1, wherein a number average liquid-droplet diameter of the spray liquid in the spraying step is less than 5 μm.

* * * * *